US007146825B2

(12) United States Patent
Seo

(10) Patent No.: US 7,146,825 B2
(45) Date of Patent: Dec. 12, 2006

(54) REFRIGERATOR

(75) Inventor: Sang-Ho Seo, Gwangmyeong (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/461,409

(22) Filed: Jun. 16, 2003

(65) Prior Publication Data

US 2004/0139762 A1 Jul. 22, 2004

(30) Foreign Application Priority Data

Jan. 21, 2003 (KR) ..... 10-2003-0004136

(51) Int. Cl.
*F25D 17/06* (2006.01)

(52) U.S. Cl. ..... 62/428; 62/508

(58) Field of Classification Search ..... 62/428, 62/259.1, 291, 427, 455, 180, 181, 183, 186, 62/305, 506–508, 248
See application file for complete search history.

(56) References Cited

U.S. PATENT DOCUMENTS 3,877,247 A * 4/1975 Le Couturier ..... 62/428
3,935,715 A * 2/1976 Newton ..... 62/475
4,331,690 A * 5/1982 Bradshaw ..... 426/233
4,376,424 A * 3/1983 Mazur ..... 123/41.12
4,490,991 A * 1/1985 Griffin ..... 62/279
4,567,676 A * 2/1986 Conti ..... 34/202
5,265,433 A * 11/1993 Beckwith ..... 62/90
5,428,973 A * 7/1995 Temmyo et al. ..... 62/452
5,775,120 A * 7/1998 Inazuka et al. ..... 62/259.1
5,881,567 A * 3/1999 Junge et al. ..... 62/428
5,966,958 A * 10/1999 Maynard ..... 62/277
6,076,363 A * 6/2000 Morton ..... 62/89
6,094,934 A * 8/2000 Rand et al. ..... 62/440
6,190,618 B1 * 2/2001 Nekozuka et al. ..... 422/108
6,237,677 B1 * 5/2001 Kent et al. ..... 165/110
6,314,748 B1 * 11/2001 Zhu et al. ..... 62/263
6,401,476 B1 * 6/2002 Zhu et al. ..... 62/262

FOREIGN PATENT DOCUMENTS

JP 60-134129 A 7/1985
JP 08-247620 A 9/1996
KR 1020010090913 A 10/2001

* cited by examiner

*Primary Examiner*—Mohammad M. Ali
(74) *Attorney, Agent, or Firm*—Birch, Stewart, Kolasch & Birch, LLP

(57) ABSTRACT

Disclosed is a refrigerator comprising: a compressor installed in a machine chamber for compressing refrigerant of low temperature and low pressure into refrigerant of high temperature and high pressure; a condenser upright installed at one inner side of the machine chamber for heat-exchanging the refrigerant which passed the compressor with external air of the machine chamber; and a cross flow fan upright installed near the condenser for sucking air and cooling the condenser.

18 Claims, 8 Drawing Sheets

REFRIGERATOR

This nonprovisional application claims priority under 35 U.S.C. § 119(a) on Patent Application No(s). 10-2003-0004136 filed in KOREA on Jan. 21, 2003, which is herein incorporated by reference.

BACKGROUND OF THE INVENTION

1. Field of the Invention

The present invention relates to a refrigerator, and more particularly, to a refrigerator capable of maximizing an inner capacity of a freezing chamber by minimizing a volume of a machine chamber.

2. Description of the Related Art

Generally, a refrigerator is a freezing and a chilling apparatus for storing food freshly for a long time by repeating a refrigerating cycle in which refrigerant is compressed, condensed, expanded, and evaporated and thus making inner temperature thereof low.

The refrigerator is divided into a freezing chamber for storing food at a temperature state below zero, a chilling chamber for storing food at a temperature state above zero, and a machine chamber formed at the lower portion of the freezing chamber.

The machine chamber is provided with a compressor for compressing refrigerant of low temperature and low pressure into refrigerant of high temperature and high pressure so as to perform the refrigerating cycle; a condenser for heat-exchanging the refrigerant which passed the compressor with external air; and an axial flow fan for radiating the compressor and the condenser.

FIG. 1 is a longitudinal section view showing a refrigerator in accordance with the conventional art, and FIG. 2 is a perspective view showing a machine chamber of the refrigerator in accordance with the conventional art.

As shown, in the conventional refrigerator a machine chamber 12 is positioned at the lower portion of a freezing chamber 11, a compressor 13 for compressing refrigerant of low temperature and low pressure into refrigerant of high temperature and high pressure is installed at one inner side of the machine chamber 12, and a condenser 14 connected with the compressor 13 and for radiating much heat is installed at another inner side of the machine chamber 12.

An axial flow fan 15 for forcibly blowing heat generated in the machine chamber 12, especially generated from the condenser 14 outside the machine chamber and thus cooling inside of the machine chamber 12 is engaged to a fan motor 16 at one side of the condenser 14.

Also, a machine chamber cover 17 having a plurality of air inlets 17*a* and a plurality of air outlets 17*b* is installed at an outer side of the machine chamber 12 in order to protect said devices and smoothly radiate in the machine chamber 12.

In the conventional refrigerator, if the refrigerator is turned on, the refrigerating cycle in which refrigerant is compressed, condensed, expanded, and evaporated is repeated and thus inner temperature of the refrigerator is lowered.

At this time, the fan motor 16 rotates the axial flow fan 15, sucks air through the air inlets 17*a*, and exhausts the air through the air outlets 17*b*, thereby cooling heat generated from the condenser 13 and the compressor 14.

However, in the conventional refrigerator, since the axial flow fan having a predetermined radius had to be installed in the machine chamber, it was limited to decrease a volume of the machine chamber.

The larger an entire volume of the machine chamber becomes, the smaller a volume of the freezing chamber and the chilling chamber becomes. According to this, it is difficult to store much food in the freezing chamber and the chilling chamber.

Also, in the conventional refrigerator, since the axial flow fan blows air unevenly due to its characteristic and thus air flow is not smooth, air sucked through the air inlets is not exhausted fast towards the outer side of the machine chamber cover through the air outlets. According to this, a radiation efficiency of the condenser and the compressor is degraded, a performance of the condenser and the compressor is lowered, and thus an entire cooling performance of the refrigerator is lowered.

SUMMARY OF THE INVENTION

Therefore, an object of the present invention is to provide a refrigerator capable of maximize an inner capacity of a freezing chamber by installing an upright condenser and a cross flow fan and thus minimizing a volume of a machine chamber.

Another object of the present invention is to provide a refrigerator capable of enhancing a radiation efficiency by smoothly guiding air stream which cools the condenser.

To achieve these and other advantages and in accordance with the purpose of the present invention, as embodied and broadly described herein, there is provided a refrigerator comprising: a compressor installed in a machine chamber for compressing refrigerant of low temperature and low pressure into refrigerant of high temperature and high pressure; an upright condenser upright installed at one inner side of the machine chamber for heat-exchanging the refrigerant which passed the compressor with external air of the machine chamber; and a cross flow fan upright installed near the condenser for sucking air and cooling the condenser.

An air guide member for covering the condenser and the cross flow fan and guiding air stream is further installed in the machine chamber.

The air guide member is provided with an air inlet at one side thereof and an air outlet at another side thereof.

The cross flow fan and the condenser are mounted in the air guide member as a unit.

The cross flow fan comprises: a body having a plurality of parallel wings; a bearing installed at one side of the body for supporting the body; and a fan motor installed at another side of the body for rotating the body.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
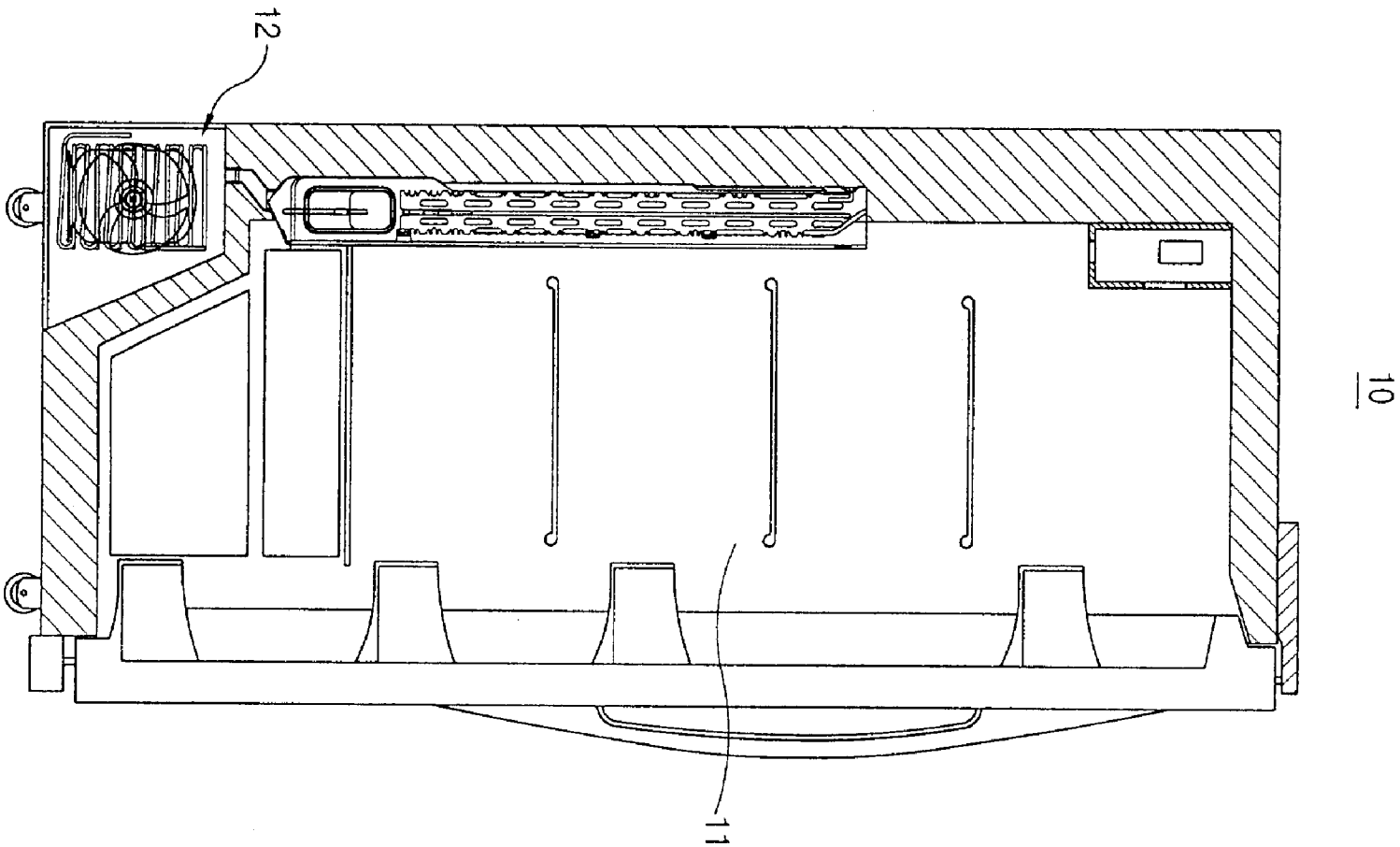
FIG. 1 CONVENTIONAL ART
FIG. 1 is a longitudinal section view showing a refrigerator in accordance with the conventional art.
Figure 2:
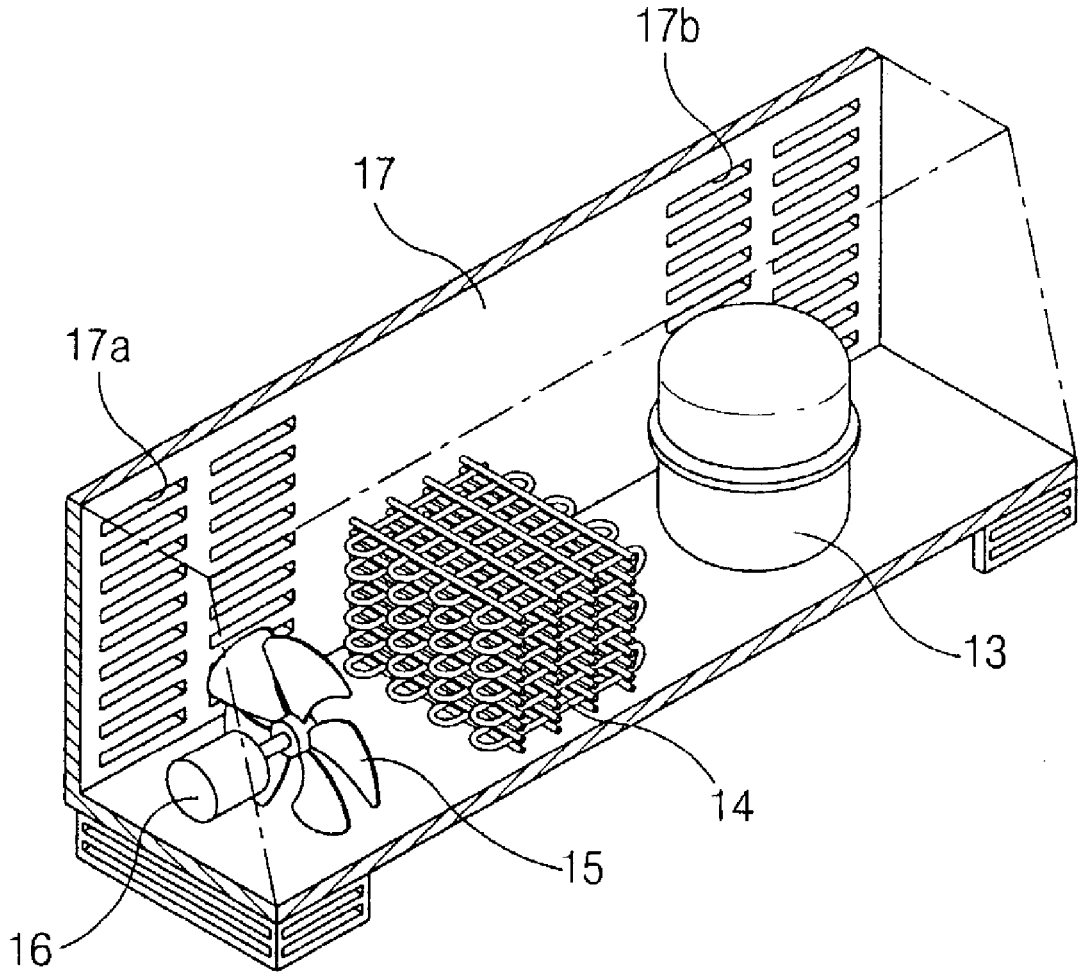
FIG. 2 CONVENTIONAL ART
FIG. 2 is a perspective view showing a machine chamber of the refrigerator in accordance with the conventional art.
Figure 3:
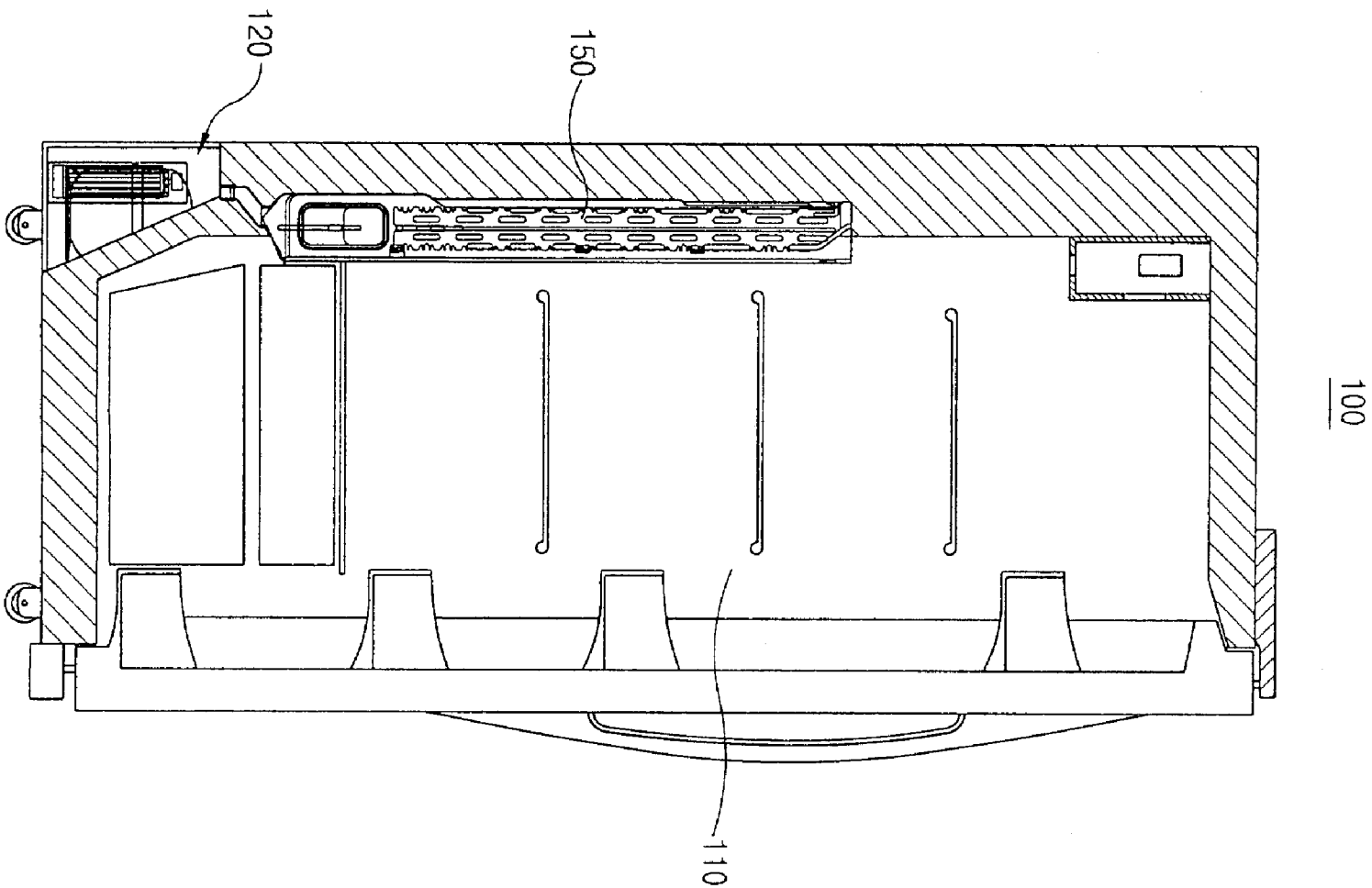
FIG. 3 is a longitudinal section view showing a refrigerator according to the present invention.
Figure 4:
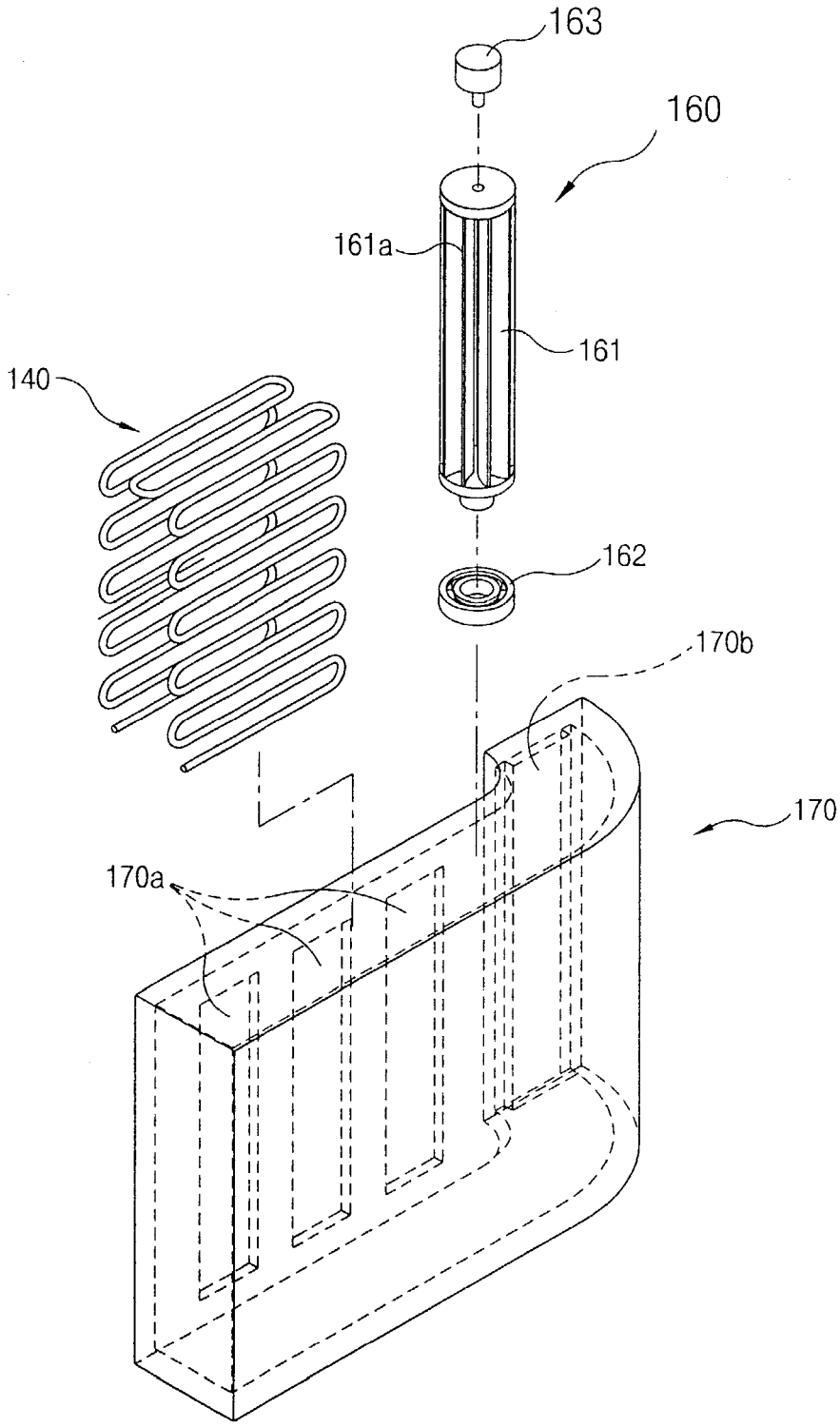
FIG. 4 is a disassembled perspective view showing a machine chamber of the refrigerator according to the present invention.
Figure 5:
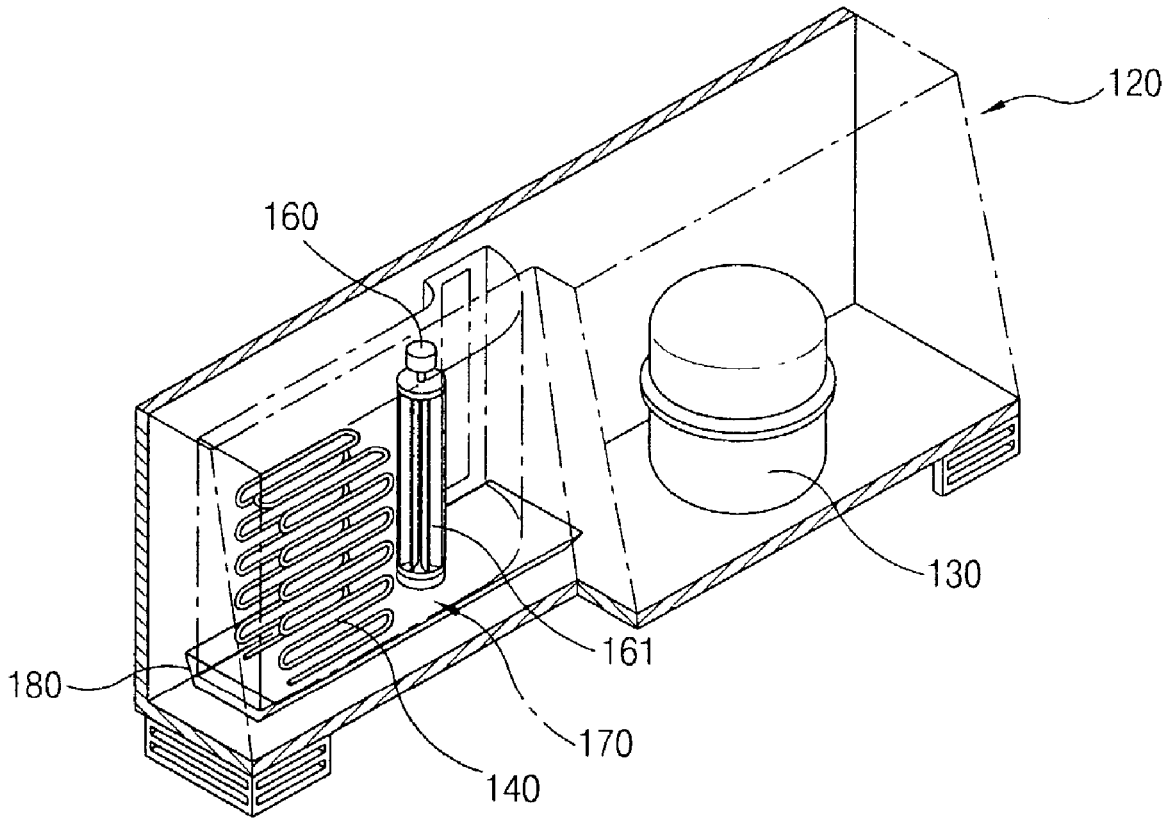
FIG. 5 is an assembled perspective view showing the machine chamber of the refrigerator according to the present invention.
Figure 6:
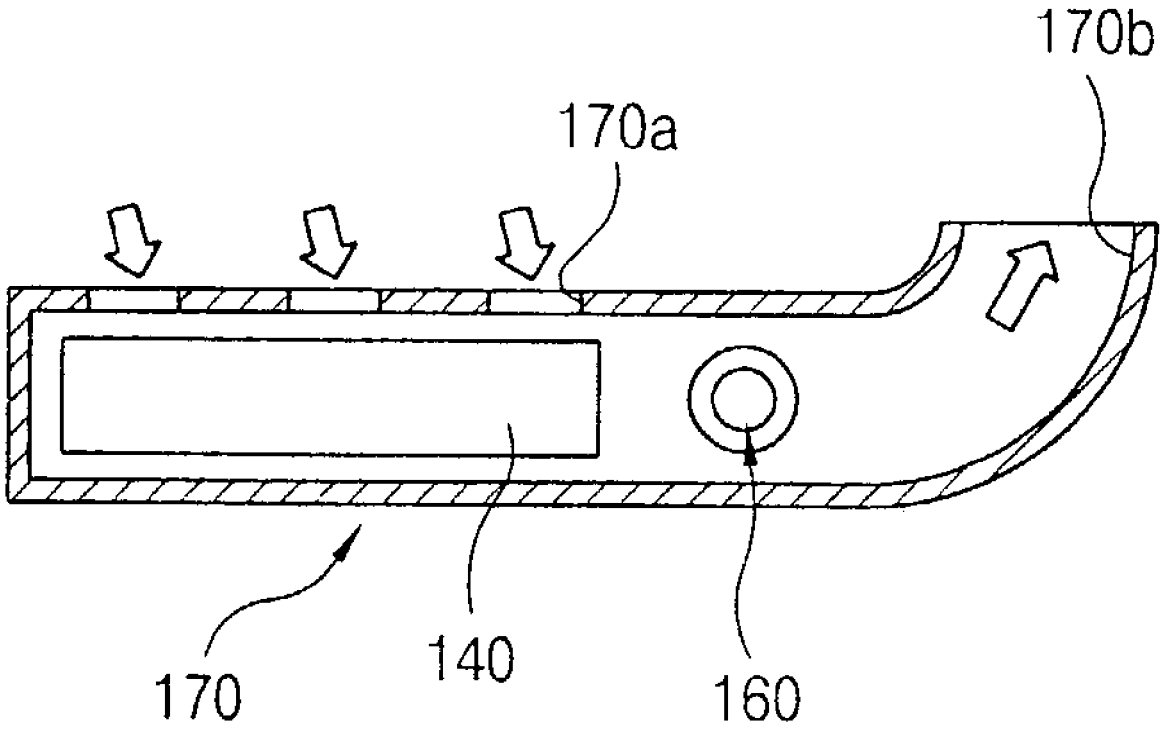
FIG. 6 is a sectional view showing air stream of the machine chamber of the refrigerator according to the present invention.

FIG. 3 is a longitudinal section view showing a refrigerator according to the present invention, FIG. 4 is a disassembled perspective view showing a machine chamber of the refrigerator according to the present invention, FIG. 5 is an assembled perspective view showing the machine chamber of the refrigerator according to the present invention, and FIG. 6 is a sectional view showing air stream of the machine chamber of the refrigerator according to the present invention.

As shown, a refrigerator 100 according to the present invention is divided into a freezing chamber 110 for storing food at a temperature state below zero, a chilling chamber (not shown) for storing food at a temperature state above zero, and a machine chamber 120 formed at the lower portion of the freezing chamber 110.

A compressor 130 for compressing refrigerant of low temperature and low pressure into refrigerant of high temperature and high pressure is installed at one inner side of the machine chamber 120, and a condenser 140 for heat-exchanging the refrigerant which passed the compressor with external air of the machine chamber 120 is upright installed at another inner side of the machine chamber 120.

The condenser 140 has a rectangular shape by being compacted, and is upright installed at one side of the machine chamber 120 so as to minimize a volume of the machine chamber 120.

The compressor 130 and the condenser 140 are fixed to inside of the machine chamber 120 by a general engaging means such as bolting or welding. The condenser 140 has one end connected to the compressor 130 and another end connected to an evaporator 150.

A cross flow fan 160 is installed near the condenser 140 so as to cool the condenser 140 by sucking external air of the machine chamber 120.

In the present invention, the upright condenser 140 is installed at one inner side of the machine chamber 120, and the cross flow fan 160 is installed near the upright condenser 140. According to this, an entire volume of the machine chamber 120 is reduced and thus an inner capacity of the freezing chamber 110 can be increased.

The cross flow fan 160 comprises: a body 161 having a plurality of parallel wings 161*a*; a bearing 162 installed at one side of the body 161 for supporting the body 161; and a fan motor 163 installed at another side of the body 161 for rotating the body 161.

An air guide member 170 of a duct form is further installed in the machine chamber 120 so as to cover the condenser 140 and the cross flow fan 160 and to guide air stream.

The air guide member 170 has an air inlet 170*a* at one side thereof and an air outlet 170*b* at another side thereof.

A water container 180 is installed at the lower portion of the upright condenser 140 so as to receive water drop formed at a surface of the condenser 140 and thus to drain.

Figure 7:
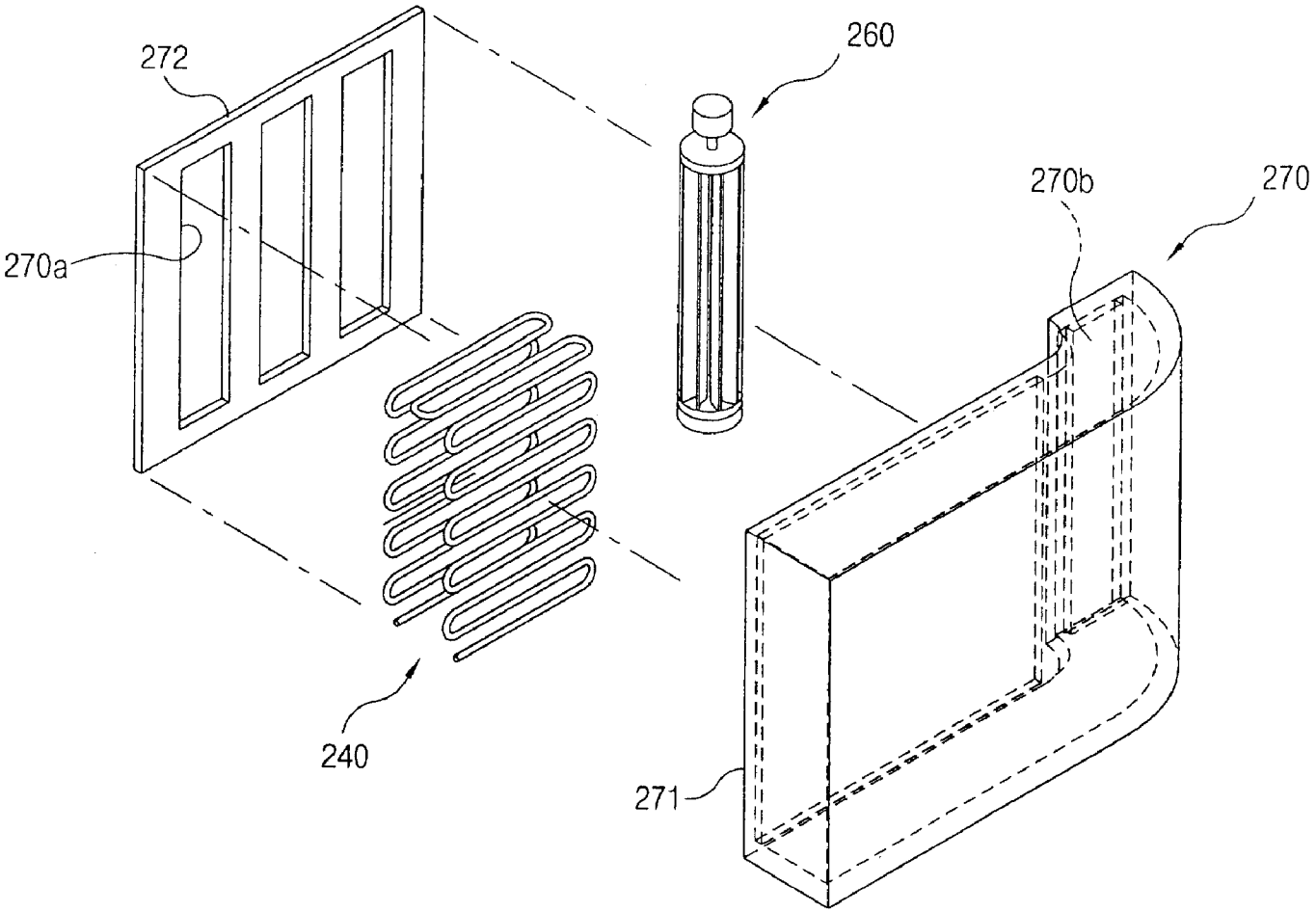
FIG. 7 is a disassembled perspective view showing a modification example of an air guide member of the refrigerator according to the present invention.
Figure 8:
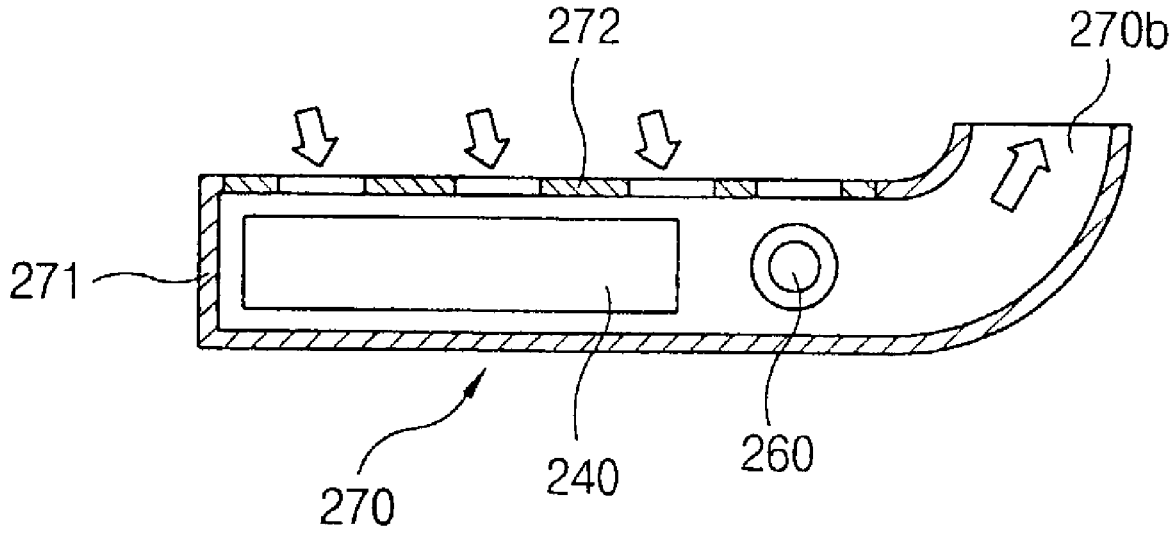
FIG. 8 is a sectional view of FIG. 7.

FIG. 7 is a disassembled perspective view showing a modification example of an air guide member of the refrigerator according to the present invention, and FIG. 8 is a sectional view of FIG. 7.

As shown, in case that a cross flow fan 260 and a condenser 240 are mounted in an air guide member 270 as a unit and the united air guide member 270 is installed in the machine chamber, the cross flow fan 260 and the condenser 240 are assemble at the same time, thereby increasing an assembly characteristic.

Also, in case of forming the air guide member 270, it is preferable to construct a body 271 having an air outlet 270*b* and a grill 272 assembled to one side of the body 271 and having an air inlet 270*a*, separately.

By constructing the body 271 and the grill 272 separately, the cross flow fan 260 and the condenser 240 can be easily assembled in the air guide member 272.

Hereinafter, effects of the refrigerator according to the present invention will be explained with reference to FIGS. 3 to 6.

First of all, if the refrigerator 100 is turned on, a refrigerating cycle in which refrigerant is compressed, condensed, expanded, and evaporated is repeated and thus inner temperature thereof is lowered.

At the same time, the cross flow fan 160 is rotated by the fan motor 163 in a state of being supported by the bearing 162.

Air sucked from the air inlet 170*a* of the air guide member 170 by the cross flow fan 160 cools the condenser 140 installed in the air guide member 170 and is discharged through the air outlet 170*b*. At this time, the cross flow fan 160 fast blows air uniformly.

Herein, the guide member 170 guides the air sucked from the air inlet 170*a* towards the air outlet 170*b* and fast discharges, thereby cooling the condenser 140 much faster.

By cooling the condenser 140 faster, a radiation efficiency is enhanced and a performance of the refrigerator is improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A refrigerator comprising:

a compressor installed in a machine chamber for compressing refrigerant of low temperature and low pressure into refrigerant of high temperature and high pressure;

a condenser upright installed at one inner side of the machine chamber for heat-exchanging the refrigerant which passed the compressor with external air of the machine chamber;

a cross flow fan vertically installed near the condenser and in the machine chamber for rotation about a substantially vertical axis and for sucking air and cooling the condenser; and an air guide member located in the machine chamber for guiding an air stream in the machine chamber, the condenser and the cross flow fan being located in the air guide member, the compressor being located outside of the air guide member, wherein the air guide member is provided with an air inlet at one side thereof and an air outlet at another side thereof.

2. The refrigerator of claim 1, wherein the air guide member is formed by constructing a body having an air outlet and a grill assembled to one side of the body and having an air inlet, separately.

3. The refrigerator of claim 1, wherein the cross flow fan comprises:

a body having a plurality of parallel wings;

a bearing installed at one side of the body for supporting the body; and a fan motor installed at another side of the body for rotating the body.

4. The refrigerator of claim 1, which further comprises:

a freezing chamber for storing food at a temperature below zero; and a chilling chamber for storing food at a temperature above zero.

5. The refrigerator of claim 1, wherein the condenser has a rectangular shape.

6. The refrigerator of claim 1, wherein the compressor and the condenser are fixed to an inside of the machine chamber by bolting or welding.

7. The refrigerator of claim 1, which further comprises a water container installed at a lower portion of the condenser.

8. The refrigerator of claim 1, wherein the condenser has one end connected to the compressor and another end connected to an evaporator.

9. The refrigerator of claim 1, wherein the cross flow fan has a plurality of vertically extending parallel wings.

10. The refrigerator of claim 1, wherein the cross flow fan and the condenser are mounted in the air guide member as a unit.

11. The refrigerator of claim 1, wherein the air inlet and the air outlet face a same direction.

12. The refrigerator of claim 1, wherein the cross flow fan is located between the air outlet and the condenser.

13. A refrigerator comprising:

a compressor installed in a machine chamber for compressing refrigerant of low temperature and low pressure into refrigerant of high temperature and high pressure;

a condenser upright installed at one inner side of the machine chamber for heat-exchanging the refrigerant which passed the compressor with external air of the machine chamber;

a cross flow fan vertically installed near the condenser and in the machine chamber for rotation about a substantially vertical axis and for sucking air and cooling the condenser; and an air guide member located in the machine chamber for covering the condenser and the cross flow fan and guiding an air stream in the machine chamber, wherein the cross flow fan and the condenser are mounted in the air guide member as a unit, and the compressor is located outside of the air guide member.

14. The refrigerator of claim 13, wherein the air guide member is formed by constructing a body having an air outlet and a grill assembled to one side of the body and having an air inlet, separately.

15. The refrigerator of claim 13, wherein the cross flow fan comprises:

a body having a plurality of parallel wings;

a bearing installed at one side of the body for supporting the body; and a fan motor installed at another side of the body for rotating the body.

16. The refrigerator of claim 13, which further comprises a water container installed at a lower portion of the condenser.

17. The refrigerator of claim 13, wherein the air guide member has an air inlet and an air outlet, the air inlet and the air outlet facing a same direction.

18. The refrigerator of claim 17, wherein the cross flow fan is located between the air outlet and the condenser.

* * * * *